US006254492B1

(12) United States Patent
Taggett

(10) Patent No.: US 6,254,492 B1
(45) Date of Patent: Jul. 3, 2001

(54) SPORTS TRAINING SYSTEM AND SPORTS VIDEO GAME

(76) Inventor: Michael Taggett, P.O. Box 16350, Wichita, KS (US) 67216

( * ) Notice: Subject to any disclaimer, the term of this patent is extended or adjusted under 35 U.S.C. 154(b) by 0 days.

(21) Appl. No.: 09/631,240

(22) Filed: Aug. 2, 2000

(51) Int. Cl.[7] ..... A63B 57/00

(52) U.S. Cl. ..... 473/219; 473/222; 473/151; 434/252

(58) Field of Search ..... 473/131, 151, 473/152, 155, 156, 190, 192, 221, 222, 223, 219; 434/252, 247; 463/36

(56) References Cited

U.S. PATENT DOCUMENTS

D. 372,286 * 7/1996 Fortini ..... D21/221
4,341,384 * 7/1982 Thackrey ..... 273/186 A
5,269,519 * 12/1993 Malone ..... 463/36
5,297,796 * 3/1994 Peterson ..... 434/252
5,342,054 * 8/1994 Chang et al. ..... 273/187.1
5,433,446 * 7/1995 Lindstedt, Jr. ..... 273/187.4
5,472,205 * 12/1995 Bouton ..... 273/187.1
5,640,777 * 6/1997 Densberger et al. ..... 473/240
5,803,823 * 9/1998 Gobush et al. ..... 473/223
6,071,202 * 6/2000 Densenberger et al. ..... 473/220

* cited by examiner

*Primary Examiner*—Jessica J. Harrison
(74) *Attorney, Agent, or Firm*—Lieberman & Nowak, LLP

(57) ABSTRACT

A sports training system for monitoring and comparing a golfer's swing to a desired norm or standard at the point of impact of a golf ball, so as to thereby detect deviation (e.g., hook or slice) from such desired norm or standard. The system of this invention is capable of permitting the golfer to refine his swing by display of the relative position of the club face and ball at point of impact, club angle at impact and the club speed at impact. Thus, the golfer is able to adjust one or more of these variables at a time and detennine the likely result or effect upon the other(s).

8 Claims, 1 Drawing Sheet

SPORTS TRAINING SYSTEM AND SPORTS VIDEO GAME

BACKGROUND OF THE INVENTION

1. Field of the Invention

This invention relates to a sports training system. More specifically, this invention is directed to system for monitoring and comparing a golfer's swing to a desired norm or standard at the point of impact of a golf ball, so as to detect deviation (e.g., hook or slice) from such desired norm or standard.

2. Description of the Prior Art

The pursuit of the perfect golf swing has been both elusive and often frustrating for the amateur and professional golfer alike. Historically, golfers have resorted to various devices to restrict or channel their swing within a preferred arc, such as special attachments to club heads (notably putters) to aid in alignment thereof relative to the ball and/or roll/terrain, and video camera recording and analysis, as a means for visually adjusting the variables that contribute to their swing. The following is representative of prior art for such physical contrivances.

U.S. Pat. No. 433,446 (to Lindstedt, issued Jul. 18, 1995) describes a device attached to a club head (or integrated at time of manufacture) that provides visual assistance to the golfer to properly position a golf club head at the time he addresses the golf ball. In brief, the Lindstedt invention utilizes a hologram affixed to the club head to confirm the proper alignment of club head relative to the golf ball, or, alternatively, to alert the golfer to improper alignment of the dub head relative to the golf ball. Where, for example, the club head is incorrectly positioned relative to the ball, a hologram on the top of club head provides an immediate visual reference and, thus, permits the golfer to adjust his grip or stance, until the holographic image appears undistorted. The Lindstedt hologram concept provides a type of three dimensional reference as to club head orientation at the point of impact of the club and the ball. The Lindstedt invention cannot aid or provide the golfer with any information relative to his unique swing characteristics at the time of impact of the club and the ball. Thus, notwithstanding proper club and ball alignment immediately prior to striking the ball with the club, the variables introduced by the dynamics of each golfer's swing remain undetected and uncorrectable with the Lindstedt device.

With the more recent developments in sensor technology, and improvement in computer analysis of data from advanced sensors, a number of creative systems have been devised to detect, view, and analyze a golfer's swing aberrations at the point of impact of the club and the ball; and, more important, to suggest or illustrate possible corrective measures. The following is representative of the prior art for such systems.

U.S. Pat. No. 5,269,519 (to Malon, issued Dec. 14, 1993) describes a video game interface that includes real time analysis, display and feedback of a golfer's swing under simulated course conditions (e.g., variations in terrain, and surface). The physical embodiment of this system includes a game simulation assembly comprising a pre-recorded video of a golf course, an array of sensors associated with a mat for detection of key parameters of the golfer's swing; and, a computer interface between the mat and the video that can translate the sensor input from the mat into a digital signal that simulates a golf ball stroke and flight relative to the golf course displayed on the video. Accordingly, the golf ball flight and position is projected onto the video for the particular hole being displayed. Thereafter, as each stroke is played (simulated), the golf ball flight and position relative to the fairway and green for each hole is simulated, and presumably, the strokes are totaled for each hole. The Malon game system also includes a "player action sensor" that provides real time feedback (data) relative to movement/swing of the golf club, (Malon patent @ col. 3, line 53 to col. 4, line 8). The player action sensor contemplated by Malon is capable of detection of club head speed at point of impact with a golf ball, angle of impact, position of the ball on the club face at time of impact and the carry distance, (Malon patent @ col. 4, line 65 to col. 5, line 1).

U.S. Pat. No. 5,297,796 (to Peterson, issued Mar. 29, 1994) describes a modification of the type of system described above in the Malon patent. More specifically, in the Peterson concept a video display is incorporated within or beneath a sensing mat on which the golf ball is placed (golf tee), so as to permit the golfer to view the computer analysis of his swing as it impacts the golf ball on the golf tee, and without looking up. Thus, the golfer is able to maintain his golf stance and follow through while observing the computer generated analysis of his swing.

U.S. Pat. No. 5,342,054 (to Chang et al., issued Aug. 30, 1994) describes an integrated golf swing analysis system that includes a database file of an individual golfer, an optical sensor array within a golf mat (and tee) for receiving a golf ball, a video camera system for recording the golfer's swing and an infrared (IR) camera positioned above the golf mat. Each of the video camera and infrared camera is coupled to a video image storage and processing system. The infrared (IR) camera is coupled to an infrared flash unit that takes a snapshot of the golf swing just before and just after the club head strikes the ball on the tee. The use of the infrared camera and infrared flash unit eliminates the distraction of visible light flash and tie "blinding" of the golfer as a result of repeated photos. The image processing and retrieval capability of the system allows the golfer to retrieve and display images of his golf swing, within the space defined by a sensor array, at various stages of the travel of the golf club.

U.S. Pat. No. 5,472,205 (to Bouton, issued December 1995) describes a video golf game that is responsive to a golfer's swing of a golf club. Like Malon and Chan et al. discussed above, the Bouton game, and associated golf swing analysis system, capture sensor information relative to club impact with a golf ball, and thereafter processes such information in a unique manner to provide impact, speed and a club/golf ball impact profile. This is accomplished by what is characterized as "offset processing" of the data from adjacent photosensors, and comparison thereof, to determine an offset angle. The results obtained from comparisons of successive data samples are accumulated and compared to stored reference values, which correspond to one of three data sets, (indicative of a "hook", "slice" or "straight" golf ball flight). The information sensing and processing capability also includes determination of the club height relative to the golf ball at impact, (e.g., "thin hit", "fat hit" or "sweet hit").

As is evident from the foregoing, golf swing analysis is both complex and an imperfect art. The prior art systems are necessarily complex because of the necessity to adapt to the individual characteristics of each golfer's swing and to the respective golf club of choice. Accordingly, the ability to sense, record and process club face/golf ball impact data, and correlate such data with an individual's golf swing parameters, is difficult at best, and provides limited corrective instruction for improvement. Thus, there is a continuing need for simplification and, to some extent, standardization of the golf swing analysis processing to permit meaningful feedback to the golfer, in essentially real-time, so as to permit adjustment of his golf stroke and thereby improvement in his game.

OBJECTS OF THE INVENTION

It is the object of this invention to remedy the above as well as related deficiencies in the prior art.

More specifically, it is the principle object of this invention to provide a system and method for a golfer to simply and precisely refine their golf swing.

It is another object of this invention to provide a golf swing analysis system wherein the golf club incorporates an indicator that can be aligned with a displayed image to achieve proper club head orientation with respect to a golf ball.

It is yet another object of this invention to provide a golf swing analysis system wherein the golf club incorporates a standardized reference material that includes a holographic image indicative of a plurality of club head orientations.

It is yet another object of this invention to provide a golf swing analysis system wherein the target frame, within the sensing field, can be easily calibrated for changes in video camera positioning and for different golf club heads.

Additional objects of this invention include the provision of a golf video game incorporating the golf swing analysis system.

SUMMARY OF THE INVENTION

The above and related objects are achieved by providing an improved golf swing analysis system that utilizes an indicator on the club face of the golf club head, such as a "cross hairs," to precisely define the "sweet spot" (i.e., the optimal contact point of the club head with a golf ball) on the club face. Proper orientation of the golf club head with a simulated golf ball "target space" is achieved by lining up the "cross hairs" on the golf club face with a "cross hairs" displayed on a t.v. monitor. The club face further incorporates thereon a standardized reference material that is indicative of a plurality of club head orientations within a target frame. The "cross hairs" is superimposed on the standardized reference material. Specifically, if the "sweet spot" is properly aligned to hit the "target space", the standardized reference material on the club becomes indistinguishable from the club face, or, alternatively, is monitored as undistorted. Where, however, the orientation of the club head relative to the "target space" at the point of contact is outside the optimal or normal angle for such contact, the camera sees avisual distortion within the reference material. For each position of the club head (e. g., hook, slice, thin hit, fat hit, etc.) relative to the "target space" that is outside the optimal or normal angle of contact, the visual or perceptible distortion of the standardized reference material is different and can be directly correlated with a characteristic "miss hit" of the golf ball. In the preferred embodiments of this invention, the reference material is in the form of a hologram, and, thus, an angular distortion of such hologram from the optimal or normal angle of contact is indicative of deviation of contact of the sweet spot of the club and the ball in at least one angular plane. This preferred standardized reference material could be an adhesive backed piece of thin plastic with a laminated hologram and "cross hairs" superimposed on it that would be centered on the "sweet spot" and stuck to the club face of a golf club.

In the preferred system of this invention, an array of sensors is also disposed within a golf mat; the number and arrangement thereof defining a "target frame". The "target frame" typically includes a golf tee or a simulated, flat representation of a golf ball ("golf ball representation") at the center thereof, at least two sets of motion sensors spatially arranged along the path of travel of the club head through the target frame. The space directly above the golf tee or golf ball representation and having the same size, shape and dimensions as a standard golf ball is designated the "target space." The golf tee or golf ball representation serves as a visual aid for the golfer to swing his club to hit the "target space". A small marker with a "cross hairs" is placed in the golf tee or the center of the golf ball representation, with the "cross hairs" marking the center of the "target space" above the "target frame". This is to allow the golfer to position a video camera relative to the "target frame" and to align the "cross hairs" on the marker with the "cross hairs" on the monitor screen. Once both "cross hairs" are aligned the marker is removed, leaving the "target space" empty. To begin analysis of his golf swing, the golfer swings his club to "strike" the "target space" (the club, of course, does not "strike" a physical object). The video camera is used for taking snapshots of the club head as it "strikes" the "target space", including, specifically, the "cross hairs" and the standardized reference material associated with one of the surfaces of the golf club. The video "snapshot" provides the golfer with a visual composite image of the golf club relative to the "target space" (golf ball) on a video display; any departure or deviation thereof from the "sweet spot" is illustrated within the video display by characteristic color changes associated with the golf club head or striking surface and a misalignment or deviation of the "cross hairs" on the club head with the "cross hairs" on the monitor. Moreover, information relative to club head speed at or prior to "striking" the "target space" within the target frame is also computed and displayed. Thus, where the angle of club impact to the target is outside the value for "sweet spot" contact (e.g., would produce a slice), such deviation from the "sweet spot" could be depicted, for example, as a change in color or tone from the color or tone of the reference material. Similarly, the thin or fat hit could be depicted, for example, by a corresponding different color change within the reference material and misalignment of the "cross hairs" on the club head with those on the monitor. Because the sensor information is keyed, in part, to the "cross hairs" and the standardized reference material associated with the golf club, the variables that need be processed to conduct such analysis are simplified, as is the speed for completion of such analysis. Moreover, where the orientation of the club head relative to the "target space" deviates from the sweet spot in more than one axis, the deviation would be displayed as a composite image relative to the target frame.

The system of this invention is therefore capable of permitting the golfer to refine his or her swing by display of the relative position of the club face and "target space" at point of impact, club angle at impact and the club speed atimpact. Thus, the golferis able to adjust one or more of these variables at a time and determine the likely result or effect upon the other(s).

DESCRIPTION OF THE INVENTION INCLUDING PREFERRED EMBODIMENTS

For purposes of simplification of discussion and explanation, the concept of this invention is discussed in reference to analysis of a golfer's swing of a golf club and a video game involving analysis of a golfer's swing in the context of performance of various golf shots in a computer simulated round of golf. It is understood that the concept and principles of this invention also have application to other sports activities involving rackets, bats, hockey sticks, etc., and that the principles and concepts discussed herein have application to both training and video games for such other sports activities.

In one of the preferred embodiments of the concepts herein described, this invention relates to an improved sports training and/or video game system which utilizes a golf club having incorporated therein a "cross hairs" and standardized reference material that is indicative of a plurality of club head orientations within a target frame.

Figure 1:
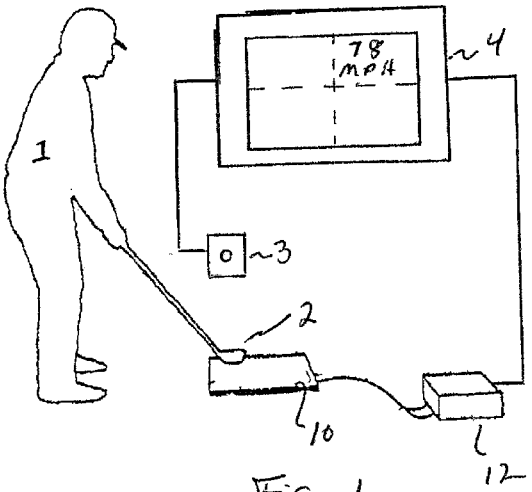
FIG. 1 is perspective of a preferred embodiment of the sports training system of this invention as applied to computer simulation and analysis of a golfer's swing.
Figure 4:
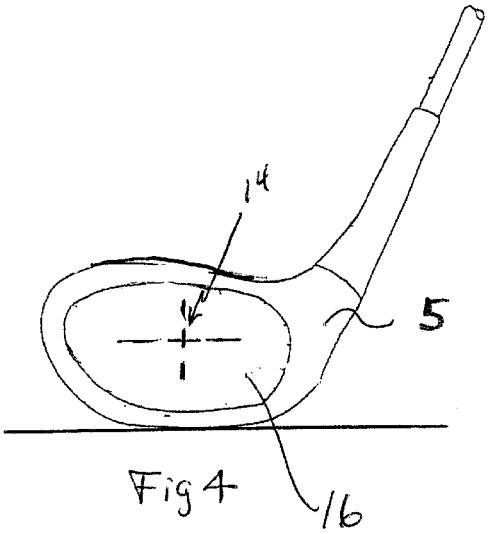
FIG. 4 is an enlarged perspective view of the head of the golf club shown in FIG. 1, viewed from the camera's perspective, when the club head is aligned relative to ball contact in the intended line of flight, (also herein "correct" or "ideal" position).
Figure 2:
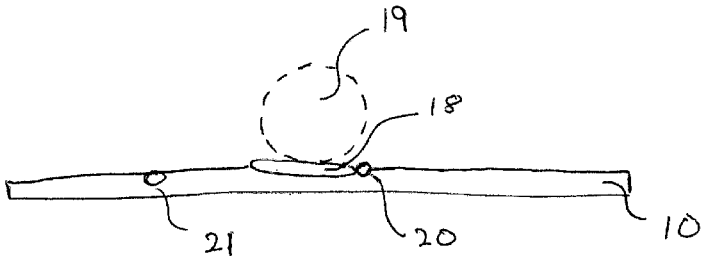
FIG. 2 is a cross-sectional view of the targetframe of the sports training system of FIG. 1 as viewed from the side facing the golfer.

FIG. 1 provides a simplified perspective view of the improved sports training system of this invention as applied to computer simulation and analysis of a golfer's swing. In brief, the golfer (1) initially places the golf club head (2) on a target frame (10). A ball is not used, but the club face is aligned with a flat representation of a golf ball (18) in FIG. 2. The space directly above the golf ball representation with the same dimensions as a standard golf ball is designated the "target space" (19). The target frame (10) also includes sensors (20) placed directly behind the line of contact with the "target space", and sensors (21) placed forward of the "target space" which function as described below. The video camera (3) is positioned by means of a marker (not shown) so that it focuses precisely on the contact point of the face of the golf club (5) with the "target space" as the club is swung. Once the video camera (3) is positioned correctly, the marker is removed. The video camera (3) is connected to television monitor (4). A computer (12) is also connected to target frame (10), and also connected to television monitor (4). As shown in FIG. 1, a cross-hatch indicator is constantly shown on monitor (4), and a similar cross-hatch indicator (14) is also affixed to the club face as shown in FIG. 4. Also affixed to the club face in FIG. 4 is a reflective material (16) which changes color when the viewing angle is changed. This type of material is commonly used on credit cards, for example, and is referred to below as "reference material." After the initial camera set up and the marker is removed the "target space" is now ready for the player to begin swinging the club. Every time the club is swung a high speed video snapshot is taken as the club "strikes" the target space. The first objective of most golfers will be to get the "cross hairs" (sweet spot) of the club to consistently line up with the "cross hairs" on the monitor (center of the target space). By repeatedly swinging and seeing the instant snapshot immediately after each swing, the golfer can simply make small adjustments to stance, grip, back swing, etc. until they develop a "groove" and a natural, accurate and consistent swing develops. During this process, the golfer will also be getting information displayed on the t.v. monitor (4) via the reference material on the angle of the club face at the time of impact (hook or slice) and can make adjustments to correct this. Advanced golfers will be able to develop a controlled hook or slice by the same technique as sometimes these are desired for particular shots. The club head speed is also displayed after each swing and this will allow the golfer to concurrently develop control and enhancement of this important aspect.

Figure 3:
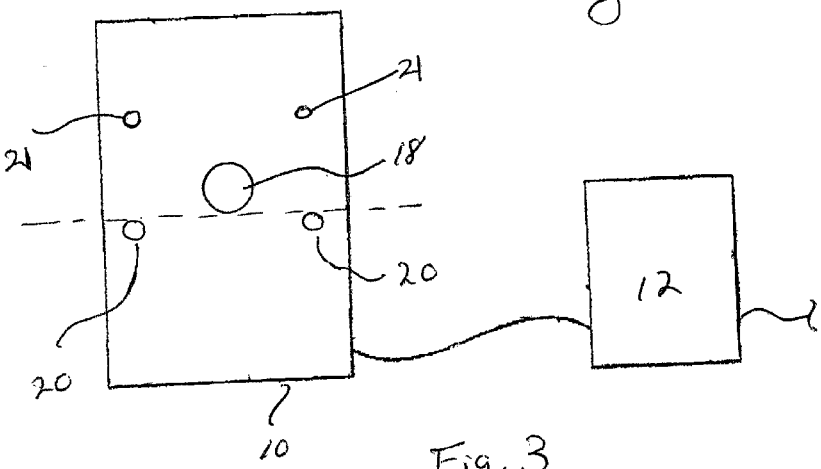
FIG. 3 is an enlarged planar view of the target frame of FIG. 2.

FIG. 3 depicts an enlarged planar view of the target frame (10) of the sports training system of FIG. 1. The target frame (10) is typically composed of a durable abrasion resistant rubber or comparable synthetic, such as ASTRO TURF®. Within the target frame (10), an array of sensors (20) are positioned immediately behind the striring point of die "target space"(19), with another array of sensors (21) positioned forward of the "target space"(19). The sensors (20), (21) are typically responsive to movement or changes in light or some other perceptible change effected by movement of the golf club relative to the "target space." For example, sensors (20) could be used to trigger the video camera (3) to take a "snap shot" at the instant of impact, and also function as the first of two timing marks with sensors (21) being the second to determine the club head velocity. The input from such sensors (20),(21) are processed in accord with well-known software routines and techniques to provide club head velocity at point of impact. As shown in FIG. 1, club head velocity can be displayed on television monitor (4).

The video "snapshot" taken by the video camera (3) which is triggered by sensor array (20) captures a still image of the club head at the time of "impact" with the target space (i.e., the instant the club head comes into contact with the "target space"). In the preferred embodiments of this invention, the "snapshot" records both the face of the club head and the reference material (16) at the instant of "impact". This "freeze-frame" "snapshot" is then displayed on the t.v. monitor (4) for observation by the golfer after he completes his swing. As described above, the "snapshot" of the "cross hairs" on the club head would show whether the "sweet spot" of the club hit the "target space" correctly. Any deviation of the club head angle from hitting the "target space" "dead-on" at the instant of impact can also be observed visually from the "snapshot" by any "remarkable" perceptible changes in color or shade of the reference material. The computer (12), or the video camera (3), or both, can store multiple video "snapshots" taken of successive golf swings so that the golfer can review them on the t.v. monitor (4) after he has taken a plurality of swings.

As illustrated in FIG. 4, the reference material (16) in the preferred embodiments of this invention may be a hologram. In an optimal swing, the image on the reference material will be seen in the "snapshot" as undistorted or has a particular color. Where perceptible changes (such as a change in color or shade) are noted, the characteristic change is identified and correlated with a club head orientation, and thus, the contact angle of the club head with the golf ball. The color characteristics of the reference material observed in the "snapshot" is indicative of the quality of the stroke (e.g. white for optimal contact, red for a hook shot, purple for a slice, green for a fat hit, and any combination thereof).

The foregoing training and stroke analysis system can be readily adapted to a video game format and to other sports activities, such as tennis or baseball batting. In each instance, the correlation of stroke and ball contact is dramatically simplified by the utilization of the standardized reference material associated with the club or racket. By knowing face position in relation to the "sweet spot," club angle and speed, a sports player can precisely refine his or her swing in a way never possible before.

The foregoing description of this invention has been provided as illustrative of a number of the preferred embodiments thereof and is not intended as defining the metes and bounds of the invention, which has been reserved for the following claims.

What is claimed is:

1. In asports training system thatincludes real time analysis, display and feedback of a golfer's swing comprising an array of sensors associated with a target frame for detection and collection of data on key parameters of a golfer's swing; a video camera for stop action recording of still photographs of the golfer's golf club at the time of impact of the golf club with a simulated ball within said target frame; and, a computer and interface coupled to input from said array of sensors for translation of said input into velocity data of said golfer's swing and outputting the velocity data to a video display, the improvement comprising:

a standardized reference material associated with a striking surface of a golf club, said standardized reference material being: (1) unremarkable or of a distinct color wherein contact between said club striking surface and said simulated ball occurs at an angle which is pre-determined to be correct or optimal for a golf swing to propel a golf ball along an intended line of flight; (2) exhibiting a characteristic image distortion or color change wherein contact between said club string surface and said simulated ball occurs at an angle that deviates from the pre-determined correct or optimal angle and is projected to cause a golf ball to deviate from the intended line of flight, means for real-time recording of said angle of contact between said club and simulated ball within said target frame, and means for conversion of data from said recording means to a video image for display.

2. The improved sports training system of claim 1, wherein said standardized reference material is a hologram.

3. The improved sports training system of claim 1, wherein said standardized reference material is affixed to a string surface of a golf club.

4. The improved sports training system of claim 1, wherein said standardized reference material includes a first cross hatch indicator, with a second cross hatch indicator being displayed on said video-display.

5. The improved sports training system of claim 1, wherein said computer includes storage means for storing data gathered from a plurality of golf swings.

6. The improved sports training system of claim 1, wherein said video camera includes storage means for storing data gathered from a plurality of golf swings.

7. The improved sports training system of claim 1, wherein said computer and interface include means to combine input from the video camera and the array of sensors into a video output for the video-display.

8. The improved sports training system of claim 1, wherein the system is adapted for use as a golf simulation game.

* * * * *